US008730106B2

(12) United States Patent
Parsche

(10) Patent No.: US 8,730,106 B2
(45) Date of Patent: May 20, 2014

(54) COMMUNICATIONS DEVICE AND TRACKING DEVICE WITH SLOTTED ANTENNA AND RELATED METHODS

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 459 days.

(21) Appl. No.: 13/009,576

(22) Filed: Jan. 19, 2011

(65) Prior Publication Data

US 2012/0182185 A1 Jul. 19, 2012

(51) Int. Cl.
*H01Q 1/38* (2006.01)
*H01Q 13/10* (2006.01)

(52) U.S. Cl.
USPC ..... 343/700 MS; 343/767

(58) Field of Classification Search
None
See application file for complete search history.

(56) References Cited

U.S. PATENT DOCUMENTS

| | | | | |
|---|---|---|---|---|
| 5,519,406 | A * | 5/1996 | Tsukamoto et al. | 343/700 MS |
| 5,729,057 | A | 3/1998 | Frenzel et al. | 307/10.3 |
| 6,284,459 | B1 | 9/2001 | Nova et al. | 435/6 |
| 6,285,338 | B1 | 9/2001 | Bai et al. | 343/882 |
| 6,324,392 | B1 | 11/2001 | Holt | 455/404 |
| 6,346,914 | B1 * | 2/2002 | Annamaa | 343/700 MS |
| 6,356,535 | B1 | 3/2002 | Smith | |
| 6,424,300 | B1 | 7/2002 | Sanford et al. | |
| 6,597,318 | B1 | 7/2003 | Parsche et al. | 343/700 |
| 7,095,376 | B1 | 8/2006 | Timothy et al. | 343/705 |
| 7,126,470 | B2 | 10/2006 | Clift et al. | 340/539.13 |
| 7,324,046 | B1 | 1/2008 | Wu | 342/359 |
| 7,333,064 | B1 | 2/2008 | Timothy et al. | 343/705 |
| 7,378,957 | B2 | 5/2008 | Twitchell, Jr. | 340/539.13 |
| 7,378,958 | B2 | 5/2008 | Twitchell, Jr. | 340/539.13 |
| 7,378,959 | B2 | 5/2008 | Twitchell, Jr. | 340/539.13 |
| 7,391,321 | B2 | 6/2008 | Twitchell, Jr. | 340/539.13 |
| 7,394,361 | B1 | 7/2008 | Twitchell, Jr. | 340/539.1 |
| 7,518,564 | B2 * | 4/2009 | Guthrie | 343/767 |
| 7,573,431 | B2 | 8/2009 | Parsche | 343/788 |
| 7,642,896 | B2 | 1/2010 | Kobayashi | 340/5.6 |
| 7,772,512 | B2 | 8/2010 | Milo | 200/341 |

(Continued)

FOREIGN PATENT DOCUMENTS

| | | |
|---|---|---|
| EP | 0401978 | 12/1990 |
| EP | 1418642 | 5/2004 |

(Continued)

OTHER PUBLICATIONS

"Electricity and Magnetism", James Maxwell, 3rd edition, vol. 2, Oxford University Press, 1892, *Spherical Coil*, pp. 304-308.

(Continued)

*Primary Examiner* — Trinh Dinh
(74) *Attorney, Agent, or Firm* — Allen, Dyer, Doppelt, Milbrath & Gilchrist, P.A.

(57) ABSTRACT

A communications device may include an electrically conductive antenna layer having a slotted opening therein extending from a medial portion and opening outwardly to a perimeter thereof, the electrically conductive antenna layer including antenna feed points. The communications device may include a first dielectric layer adjacent the electrically conductive antenna layer, an electrically conductive passive antenna tuning member adjacent the first dielectric layer, a second dielectric layer adjacent the electrically conductive passive antenna tuning member, circuitry adjacent the second dielectric layer, and electrically conductive vias extending through the first and second dielectric layers and coupling the circuitry and the antenna feed points.

33 Claims, 15 Drawing Sheets

(56) References Cited

U.S. PATENT DOCUMENTS

| | | | | |
|---|---|---|---|---|
| 7,830,312 | B2 * | 11/2010 | Choudhury et al. | 343/700 MS |
| 8,289,213 | B2 * | 10/2012 | Duchesne et al. | 343/700 MS |
| 8,571,599 | B2 * | 10/2013 | Man et al. | 455/550.1 |
| 2003/0112187 | A1 * | 6/2003 | Whitehouse | 343/702 |
| 2003/0231139 | A1 * | 12/2003 | Tai et al. | 343/795 |
| 2006/0066495 | A1 * | 3/2006 | Isoifovich et al. | 343/770 |
| 2009/0015501 | A1 * | 1/2009 | Chou et al. | 343/795 |
| 2009/0153407 | A1 * | 6/2009 | Zhang et al. | 343/702 |
| 2010/0013718 | A1 * | 1/2010 | Zhu et al. | 343/702 |
| 2010/0148968 | A1 | 6/2010 | Casden | |
| 2010/0214192 | A1 | 8/2010 | Chao | 343/906 |
| 2012/0256803 | A1 * | 10/2012 | Cozzolino et al. | 343/821 |

FOREIGN PATENT DOCUMENTS

| | | |
|---|---|---|
| EP | 2161785 | 3/2010 |
| GB | 2431053 | 4/2007 |
| JP | 2007235832 | 9/2007 |
| KR | 20100092996 | 8/2010 |

OTHER PUBLICATIONS

"The Spherical Coil As an Inductor, Shield, or Antenna", Harold A. Wheeler, Proceedings of the IRE, Sep. 1952, pp. 1595-1602.

* cited by examiner

COMMUNICATIONS DEVICE AND TRACKING DEVICE WITH SLOTTED ANTENNA AND RELATED METHODS

FIELD OF THE INVENTION

The present invention relates to the field of communications, and, more particularly, to wireless communications devices with slotted antennas and related methods.

BACKGROUND OF THE INVENTION

Wireless communications devices are an integral part of society and permeate daily life. The typical wireless communications device includes an antenna, and a transceiver coupled to the antenna. The transceiver and the antenna cooperate to transmit and receive communications signals.

A typical personal radio frequency (RF) transceiver or radiolocation tag includes an antenna, radio frequency electronics, and a battery. The antenna, electronics, and battery are often separate components comprising an assembly. Therefore, in many personal transceivers, there can be a tradeoff between battery size and antenna size, between battery capacity and antenna efficiency, and between operating time and signal quality. Antenna performance and battery capacity are related to size, yet personal electronics are typically small while external antennas are unwieldy and often impractical in these applications.

Antennas are transducers for sending and receiving radio waves, and they may be formed by the motion of electric currents on conductors. Preferred antenna shapes may guide the current motions along Euclidian geometries, such as the line and the circle, which are known through the ages for optimization. The dipole and loop antenna are Euclidian geometries that provide divergence and curl. The canonical dipole antenna is line shaped, and the canonical loop antenna is circle shaped.

Antennas generally require both electrical insulators and electrical conductors to be constructed. The best room temperature conductors are metals. As will be appreciated, at room temperature, there are excellent insulators, such as Teflon™ and air. The available electrical conductors are less satisfactory however, and in fact, all room temperature antennas may become inefficient when sufficiently small do due to conductor resistance losses. Thus, it may be important for small antennas to have large conductor surfaces. The material dichotomy between insulators and conductors may provide advantages for small loop antennas: the loop structure intrinsically provides the largest possible inductor in situ to aid efficiency. Capacitor efficiency (quality factor or "Q") can be much better than inductors so antenna loading and tuning can be realized at low loss when capacitors are used. Loop antennas can be planar for easy printed wiring board (PWB) construction and stable in tuning when body worn.

As will be appreciated by those skilled in the art, a small antenna providing high gain and efficiency would be valuable. Antenna shapes can be of 1, 2, or 3 dimensions, i.e. antennas can be linear, planar, or volumetric in form. The line, circle, and sphere are preferred antenna envelopes as they provide geometric optimizations of shortest distance between two points, greatest area for least amount of circumference, and greatest volume for a least amount of surface area. In small antennas, line, circle, and sphere shapes may minimize metal conductor losses.

Spherical winding has been disclosed as both an inductor in "Electricity and Magnetism", James Maxwell, 3rd edition, Volume 2, Oxford University Press, 1892. *Spherical Coil*, pp. 304-308 and as an antenna in "The Spherical Coil As An Inductor, Shield, Or Antenna", Harold A. Wheeler, Proceedings Of The IRE, September 1952, pp. 1595-1602. The spherical winding approach uses many turns of conductive wire on a spherical core (3 dimensional) and is space efficient. When wound with sufficient turns to self resonate, the spherical winding can have relatively good radiation efficiency for small diameters. The Archimedean spiral can be nearly 2 dimensional and an electrically small antenna of good efficiency.

The thin wire dipole can be nearly 1 dimensional and with an electrical aperture area 1785 times greater than its physical area. The thin wire dipole might offer the greatest gain and efficiency for volume. Thus, there are many advantageous shapes for electrically small antennas, but many antennas do not integrate well in personal communications. For instance, it may be difficult to mount electronic components on some, nearby batteries may shade near fields and radiation on wire loops, the tuning of wound antennas may not be stable when body worn, and whip antennas can be unwieldy. Small antenna design may include tradeoffs in size, shape, efficiency and gain, bandwidth, and convenience of use.

Many personal communication and radiolocation antennas operate on the human body. The human body is mostly water, high in dielectric constant ($\in_r \approx 50$), and conductive ($\delta \approx 1.0$ mho/meter). So in practice, the body worn antenna may have losses and the gain response may not be on the desired frequency, e.g. tuning drift. In particular, antenna electric near fields can be captured by the human body pulling antenna resonant frequency downwards by "stray capacitance." Antennas using large loading capacitors can have more stable tuning as the body stray capacitance can be small relative loading capacitance. This effect is disclosed in U.S. Pat. No. 6,597,318 to Parsche et al., which also discloses multiple large loading capacitors in series in a loop minimized antenna tuning drift near the human body.

Fixed tuned bandwidth, also known as instantaneous gain bandwidth, is thought to be limited for antennas with small relative wavelength. Indeed, there is a theoretical upper limit, which is known as the Chu-Harrington limit, and notes that the half power (3 dB) fixed tuned gain bandwidth cannot exceed $200(r/\lambda)^3$, where r is the radius of the smallest sphere that will enclose the antenna and $\lambda$ is the free space wavelength. Multiple tuning, such as Chebyschev polynomial tuning, can increase bandwidth above this by up to $3\pi$ for infinite order tuning. In practice, double tuning can increase bandwidth by a factor of 4. In multiple tuning, the antenna may become one pole of a multiple pole filter, and the filter may be provided by an external compensation network.

If light propagated at a lesser speed, all antennas would be electrically larger and with better bandwidth for size. U.S. Pat. No. 7,573,431 to Parsche discloses immersing small antennas in nonconductive materials having equal permeability and permeability, i.e. $(\mu=\in)>1$, in order to aid bandwidth at small physical size. This approach may identify that the boundaries of isoimpedance magnetodielectric ($\mu=\in$) materials are reflectionless to waves entering and leaving free space and air. The approach also may show that the speed of light is significantly slowed in isoimpedance magnetodielectric materials. Thus, these antennas can have good bandwidth inside $(\mu=\in)>1$ materials as they become electrically larger without physical size increase. Except for refraction, isoimpedance magnetodielectric materials are invisible materials at frequencies for which the isoimpedance property exists, as such materials have negligible reflections to vacuum and air.

In addition to the design concerns discussed above in regards to power efficiency and performance, there has been a desire to miniaturize wireless communications device for several reasons. Indeed, certain applications, for example, wireless tracking devices, place a premium on the miniaturization. In particular, reduced packaging may enable the wireless tracking device to be installed without substantial modification to the tracked host. Miniature radiolocation tags are useful for diverse applications, such as wildlife tracking, personnel Identification, and for rescue beacons. Of course, the miniaturization of the wireless tracking device also aids in subterfuge if the device was installed surreptitiously. One approach is disclosed in U.S. Pat. No. 6,324,392 to Holt, also assigned to the present application's assignee. This approach includes a mobile wireless device that broadcasts a wideband spread spectrum beacon signal. The beacon signal summons assistance to the location of the mobile wireless device.

Yet another approach is disclosed in U.S. Pat. No. 7,126,470 to Clift et al., also assigned to the present application's assignee. The approach includes using a plurality of radio frequency identification (RFID) tags for tracking in a network including a plurality of tracking stations.

Yet another approach is provided by the EXConnect Zigbee Chip Antenna Model 868, as available from the Fractus, S.A., of Barcelona, Spain. This chip antenna has a compact rectangular form factor and includes a monopole antenna. The chip antenna may be installed onto a printed circuit board (PCB). A potential drawback to this approach is that the PCB may need to be tuned for efficient operation for each application.

Another approach may comprise a wireless device fashioned into a business card form factor and includes a pair of paper substrates. The wireless device includes a pair of lithium ion batteries, and wireless circuitry coupled thereto. Conductive traces are formed on the paper substrates, for example, 110 lb paper, by screen printing conductive polymer silver ink thereon. The wireless device also includes a 1/10 wavelength loop antenna. A potential drawback to this wireless device is that the separated antenna and wireless circuitry may result in reduced battery life and weaker transmitted signals.

An approach may comprise a wireless tracking device fashioned into a bumper sticker form factor and includes a segmented circular antenna, a battery, and wireless circuitry coupled to the battery and antenna, each component being affixed to a substrate. Again, this wireless tracking device may suffer from the aforementioned drawbacks due to the non-integrated design.

SUMMARY OF THE INVENTION

In view of the foregoing background, it is therefore an object of the present invention to provide a communications device that is integrated and readily manufactured.

This and other objects, features, and advantages in accordance with the present invention are provided by a communications device that comprises an electrically conductive antenna layer having a slotted opening therein extending from a medial portion and opening outwardly to a perimeter thereof. The electrically conductive antenna layer comprises a plurality of antenna feed points. The communications device further includes a first dielectric layer adjacent the electrically conductive antenna layer, at least one electrically conductive passive antenna tuning member adjacent the first dielectric layer, and a second dielectric layer adjacent the at least one electrically conductive passive antenna tuning member. The communications device includes circuitry adjacent the second dielectric layer, and a plurality of electrically conductive vias extending through the first and second dielectric layers and coupling the circuitry and the plurality of antenna feed points. Advantageously, the communications device may have reduced packaging with a stacked arrangement.

In some embodiments, the slotted opening may be keyhole-shaped. The communications device may further comprise a tuning capacitor coupled across the slotted opening. Also, the communications device may further comprise dielectric fill material within the slotted opening.

For example, the slotted opening may have a progressively increasing width from the medial portion to the perimeter of the electrically conductive antenna layer. Alternatively, the slotted opening may have a uniform width from the medial portion to the perimeter of the electrically conductive antenna layer.

In particular, the circuitry may further include a wireless circuit coupled to the electrically conductive antenna layer, and a battery coupled to the wireless circuit. The communications device may further comprise a pressure-sensitive adhesive layer adjacent the electrically conductive antenna layer.

In some embodiments, the electrically conductive antenna layer, and the first and second dielectric layers may be circularly-shaped. In other embodiments, the electrically conductive antenna layer, and the first and second dielectric layers may be rectangularly-shaped.

Another aspect is directed to a tracking device similar to the communications device discussed above. The tracking device may further comprise a housing, and a pressure-sensitive adhesive layer on an exterior of the housing. The tracking device may further include a wireless tracking circuit adjacent the second dielectric layer.

Another aspect is directed to a method of making a communications device comprising forming an electrically conductive antenna layer having a slotted opening therein extending from a medial portion and opening outwardly to a perimeter thereof, and forming a plurality of antenna feed points in the electrically conductive antenna layer. The method includes positioning a first dielectric layer adjacent the electrically conductive antenna layer, forming at least one electrically conductive passive antenna tuning member adjacent the first dielectric layer, positioning a second dielectric layer adjacent the at least one electrically conductive passive antenna tuning member, positioning circuitry adjacent the second dielectric layer, and forming a plurality of electrically conductive vias that extend through the first and second dielectric layers and couple the circuitry and the plurality of antenna feed points.

BRIEF DESCRIPTION OF THE DRAWINGS

FIGS. 5-6A are diagrams of curling and diverging current flow of the communications device, according to the present invention.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
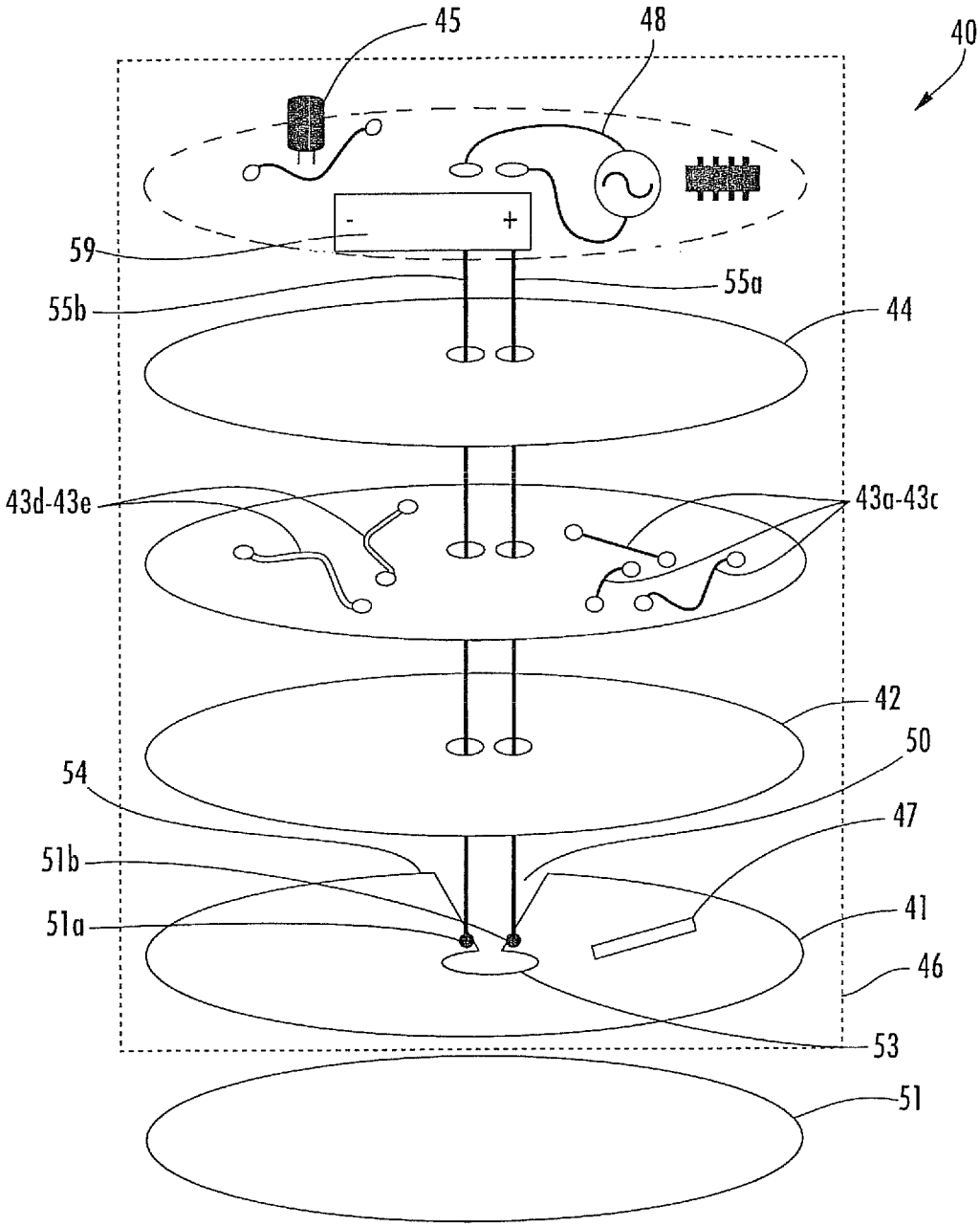
FIG. 1 is a schematic diagram of an exploded view of a communications device, according to the present invention.

Referring initially to FIG. 1, a communications device 40 according to the present invention is now described. The communications device 40 is illustratively formed into a stacked arrangement and includes an electrically conductive antenna layer 41. The electrically conductive antenna layer 41 may comprise a metal, for example. The electrically conductive antenna layer 41 includes a slotted opening 50 therein extending from a medial portion 53 and opening outwardly to a perimeter 54 thereof.

The electrically conductive antenna layer 41 comprises a plurality of antenna feed points 51*a*-51*b*. The communications device 40 further includes a first dielectric layer 42 on the electrically conductive antenna layer 41, and a plurality of electrically conductive passive antenna tuning members 43*a*-43*e* thereon. The plurality of electrically conductive passive antenna tuning members 43*a*-43*e* may be used to tune the communications device 40 operating frequency.

The communications device 40 further includes a second dielectric layer 44 on the plurality of electrically conductive passive antenna tuning members 43*a*-43*e*, and circuitry 45, 48, 59 adjacent the second dielectric layer. In particular, in the illustrated example, the circuitry illustratively includes a wireless tracking circuit 45, a power source 59 coupled to the wireless tracking circuit, for example, a battery, and a signal source 48 coupled to the electrically conductive antenna layer 41. For example, the wireless tracking circuit 45 may comprise a transceiver circuit or a transmitter or receiver, i.e. it provides a wireless circuit.

The communications device 40 also includes a plurality of electrically conductive vias 55*a*-55*b* extending through the first and second dielectric layers 42, 44 and coupling the circuitry 45, 48, 59 and the plurality of antenna feed points 51*a*-51*b*. Again, the plurality of electrically conductive vias 55*a*-55*b* may comprise metal, for example.

Also, the communications device 40 illustratively includes a housing 46 carrying the internal components. The housing 46 may comprise a metal or alternatively a plastic plated with metal. Further, in the illustrated embodiment, the communications device 40 illustratively includes a pressure-sensitive adhesive layer 51 formed on a major surface of the housing 46 to enable easy attachment to a tracked object. In other words, the communications device 40 may operate as a tracking device.

Figure 3A:
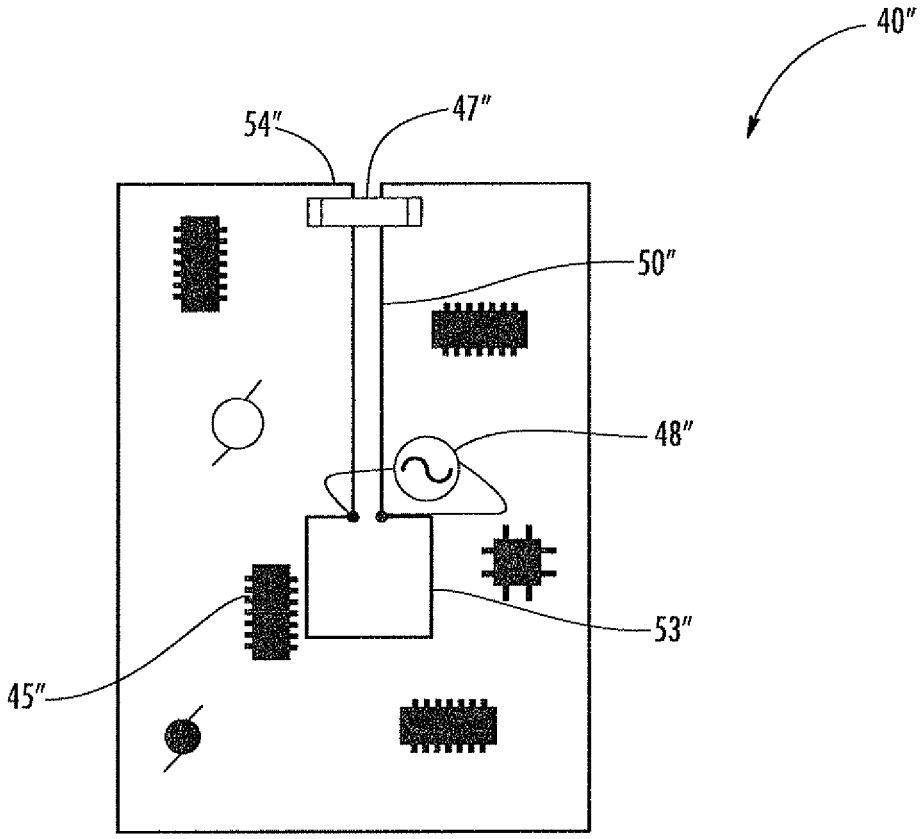
FIG. 3A is a top plan view of another embodiment of the communications device, according to the present invention, with the housing removed.

In the illustrated embodiment, the slotted opening 50 is keyhole-shaped. More specifically, the slotted opening 50 illustratively includes a progressively increasing width from the medial portion 53 to the perimeter 54 of the electrically conductive antenna layer 41. Nevertheless, in other embodiments, the slotted structure may take other forms (FIG. 3A). In the illustrated embodiment, the electrically conductive antenna layer 41 illustratively includes tuning slits 47 for making small changes in resonance and operating frequency, for example, trimming. The tuning slits 47 may be made by ablation with a knife or with a laser and add series inductance to lower the frequency of operation. Of course, the tuning slits 47 are optional and in other embodiments may be omitted.

Moreover, in the illustrated embodiment, the electrically conductive antenna layer 41, and the first and second dielectric layers 42, 44 are circularly-shaped. Nevertheless, in other embodiments, these layers may have other geometric shapes, for example, rectangular (square shaped embodiments also being a subset of rectangular) (FIG. 3A), or polygonal.

Figure 2:
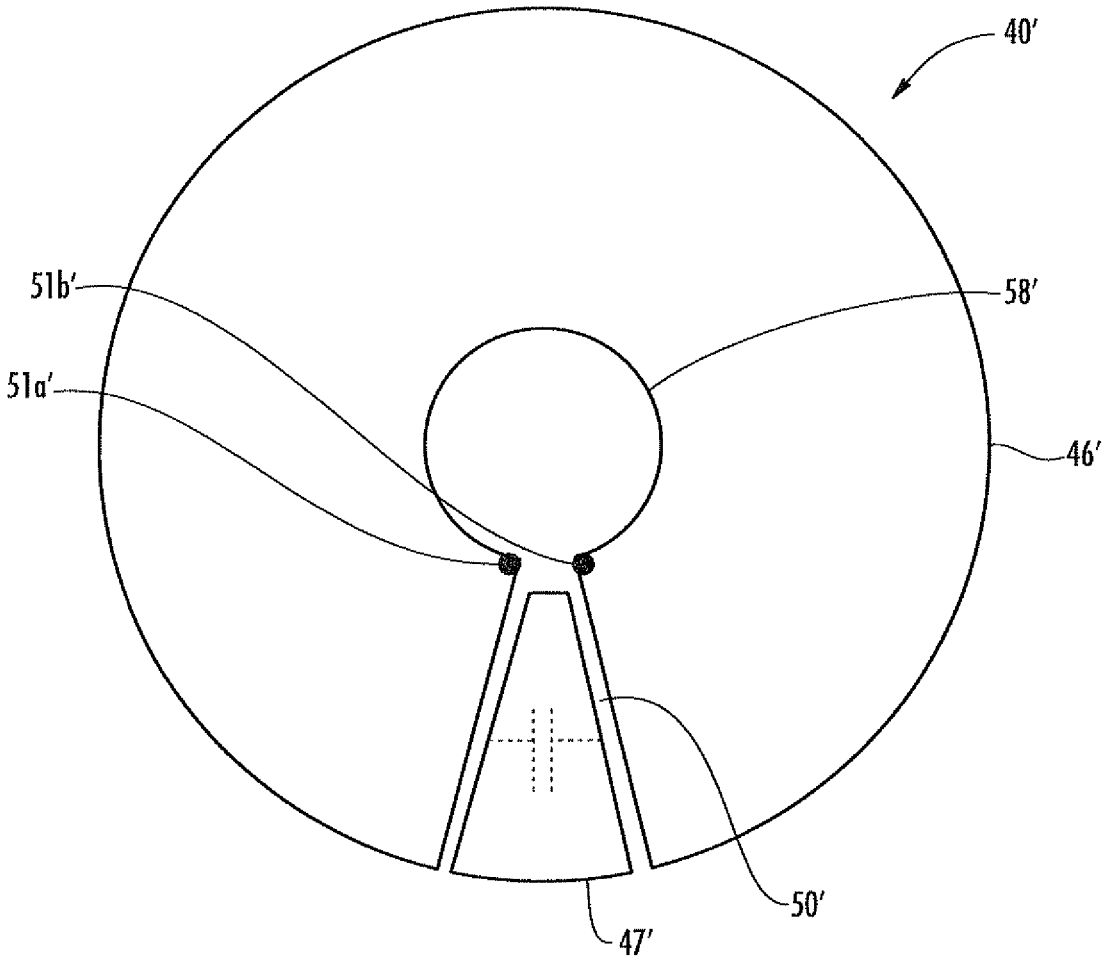
FIG. 2 is a top plan view of another embodiment of the communications device, according to the present invention.

Referring now to FIG. 2, another embodiment of the communications device 40 is now described. In this embodiment of the communications device 40', those elements already discussed above with respect to FIG. 1 are given prime notation and most require no further discussion herein. This embodiment differs from the previous embodiment in that the communications device 40' illustratively includes a tuning device 47'. The tuning device 47' may comprise, for example, a tuning capacitor (shown with shadowed lines) coupled across the slotted opening 50' or a dielectric fill material within the slotted opening. Also, the first and second dielectric layers 42', 44' and the housing 46' have a slotted opening. The pair of feed points 51*a*', 51*b*' may be preferentially located across the slotted opening 50' along the circumference of the circular portion 58' thereof. Adjusting the diameter of the circular portion 58' of the slotted opening 50' adjusts the load resistance that the communications device 40' provides. Increasing this diameter of the circular portion 58' also increases the resistance and decreasing the diameter decreases the resistance.

Referring now to FIG. 3A, another embodiment of the communications device 40 is now described. In this embodiment of the communications device 40", those elements already discussed above with respect to FIG. 1 are given double prime notation and most require no further discussion herein. This embodiment differs from the previous embodiment in that the electrically conductive antenna layer 41", and the first and second dielectric layers 42", 44" are illustratively rectangularly-shaped. Moreover, the slotted opening 50" has a uniform width from the medial portion 53" to the perimeter 54" of the electrically conductive antenna layer 41". Moreover, the medial portion 53" of the slotted opening 50" is also rectangular. Also, the first and second dielectric layers 42", 44" also have a slotted opening.

Figure 3B:
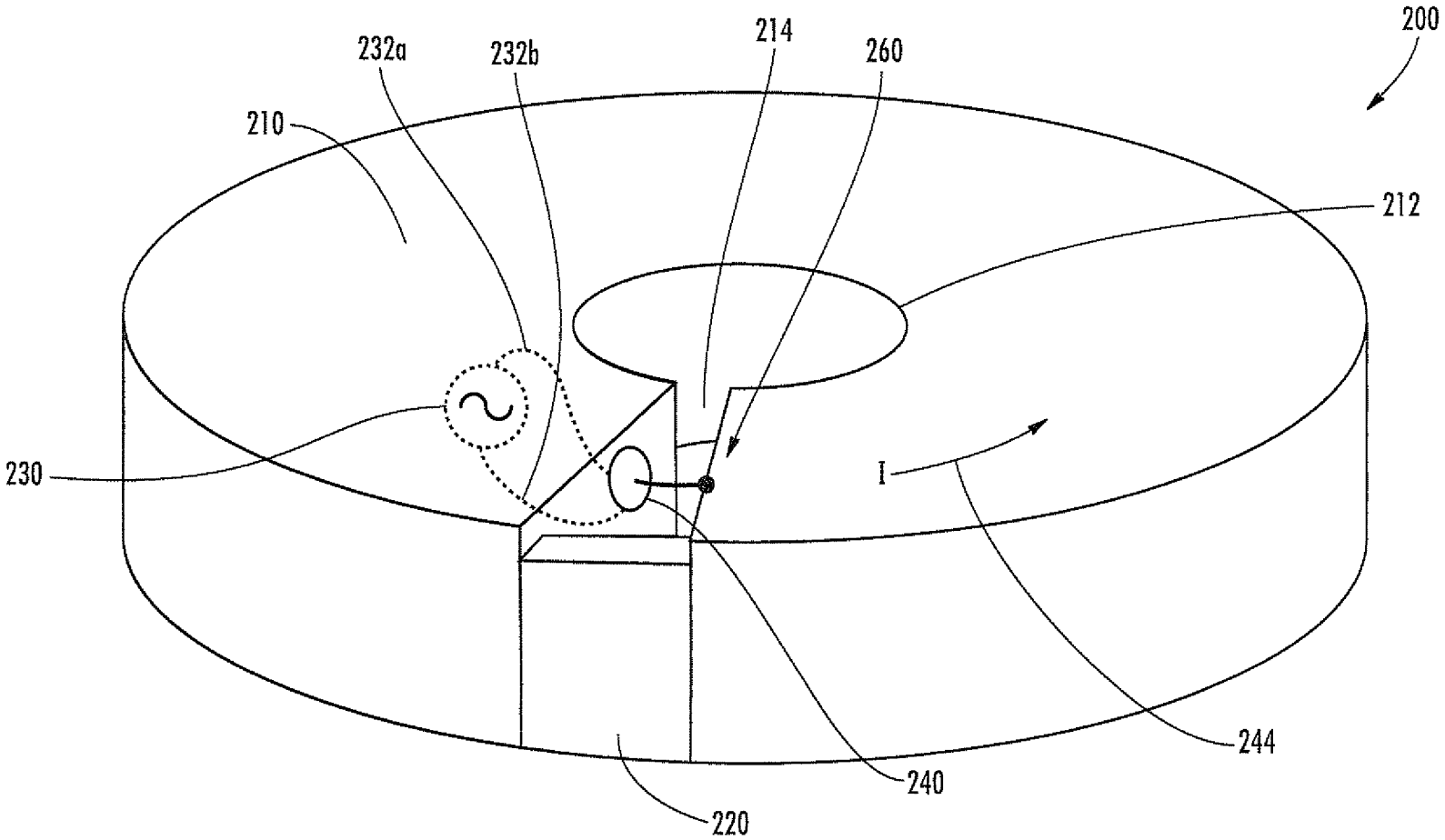
FIG. 3B is an isometric view of another embodiment of the communications device with a conductive housing, according to the present invention.
Figure 4:
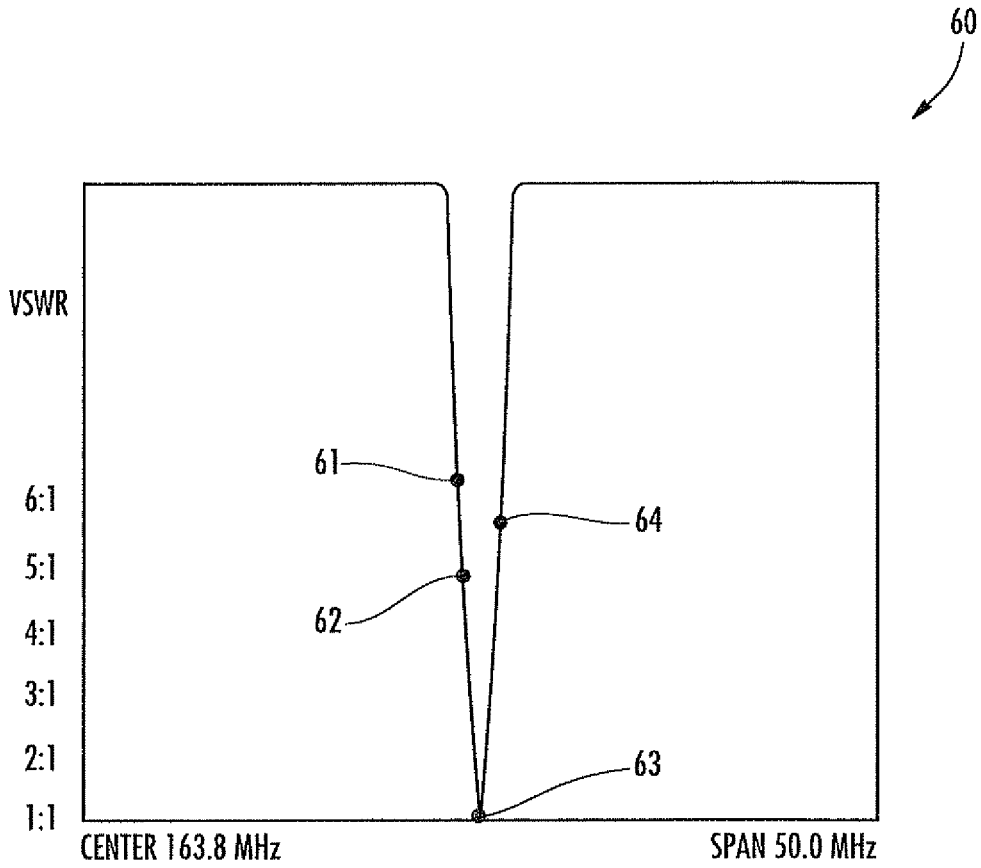
FIG. 4 is a diagram of voltage standing wave ratio performance of the communications device, according to the present invention.
Figure 5:
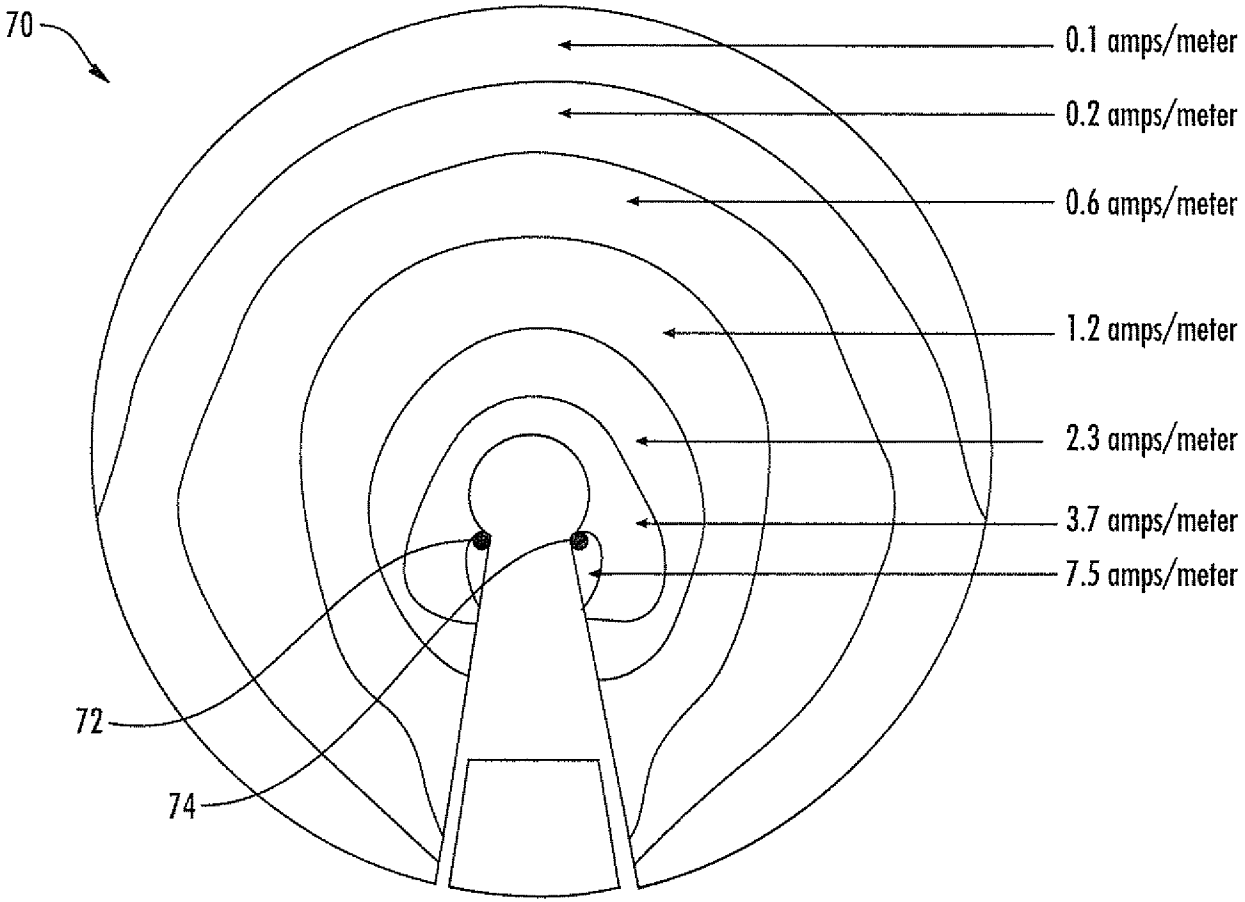
Figure 6A:
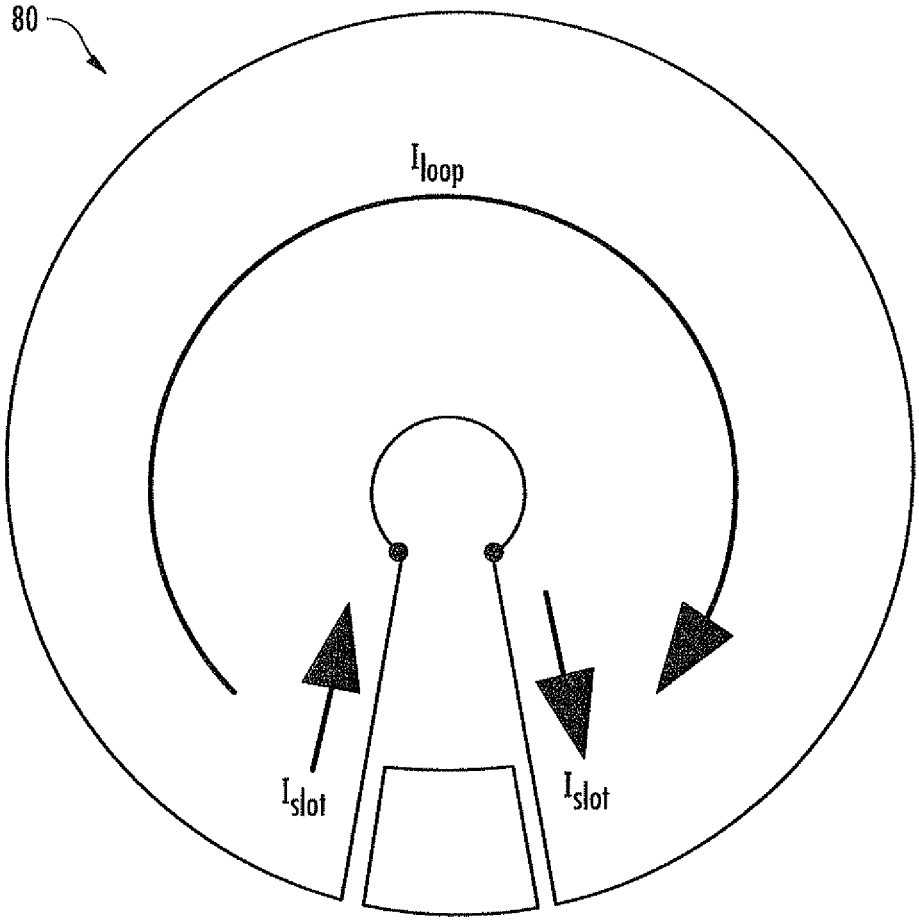
Figure 6B:
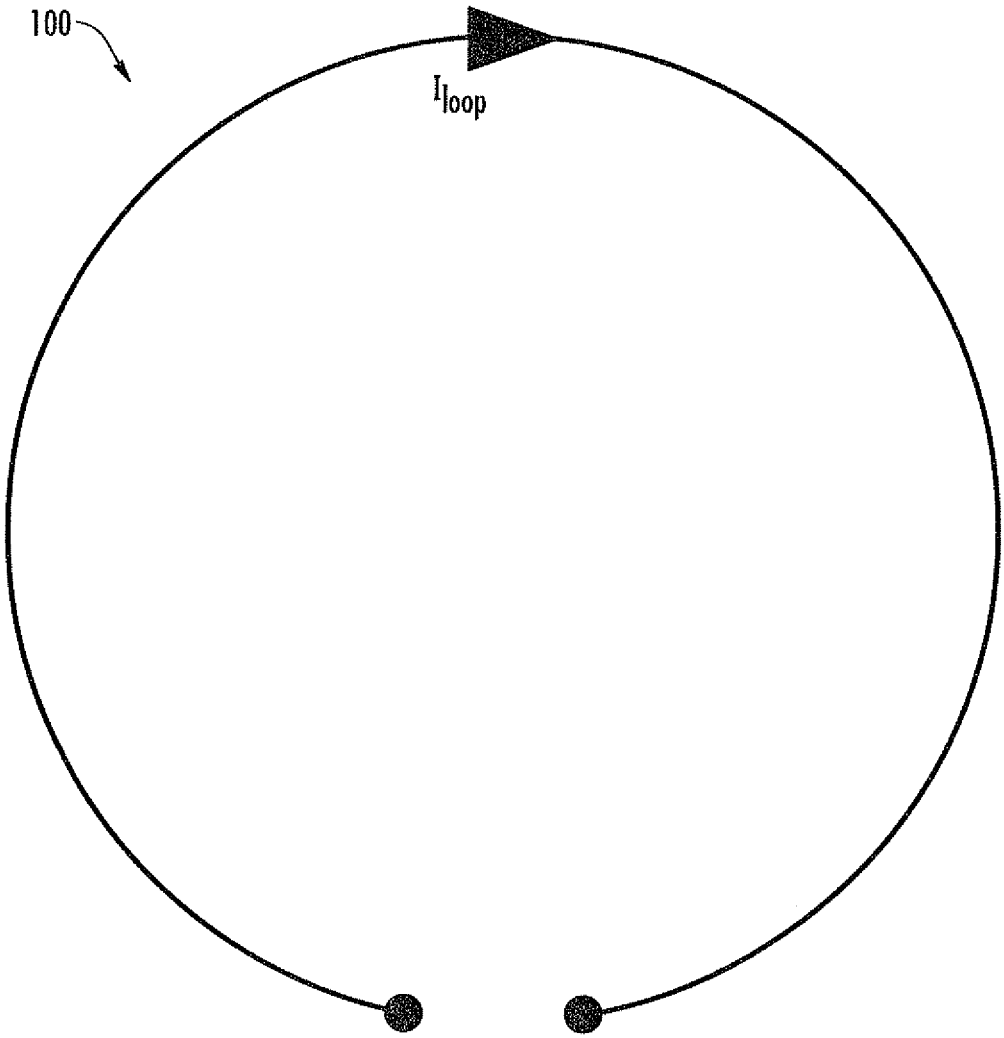
FIG. 6B (PRIOR ART)
FIG. 6B depicts a thin wire loop antenna, according to the prior art.

Referring now to FIG. 3B, another embodiment of the communications device 40 is now described. This embodiment communications device 200 illustratively includes an antenna (not shown) from a conductive housing 200. The conductive housing may comprise a hollow metal can and may have a passageway 212 extending all the way through, and a wedge-shaped notch 214 that is wider at the distal end. The communications device 200 illustratively includes a dielectric wedge 220 inserted in the wedge shaped notch 214 for loading and tuning. The communications device 200 illustratively includes an internal radio 230, such as a radio frequency oscillator, located inside the conductive housing 210 to generate a communications signal.

As will be appreciated by those skilled in the art, the internal radio may also be a receiver or a combination transmitter and receiver. The communications device 200 illustratively includes conductive leads 232*a*, 232*b*, which may comprise metal wires. The conductive leads 232*a*, 232*b* convey the radio frequency signal to and across the wedge shaped notch 214. The conductive lead 232*a* passes through an aperture 240 in the conductive housing 210 reaching the distal face of the dielectric wedge 220 for making conductive contact thereupon. The conductive lead 232*b* makes contact to the conductive housing 210 internally, without passing through the aperture 240. Radio frequency electric currents 244 circulate on the outside of the conductive housing 210 to transducer radio waves to provide radiation and/or reception.

Referring now to FIGS. 4-11*c*, several diagrams illustrate the advantageous simulated performance of the above described communications device 40 with the slotted structure 50 having non-uniform width from the medial portion 53 thereof to the perimeter 54 of the electrically conductive antenna layer 41, for example, a keyhole slot shape. It should be noted that the above-described keyhole embodiment may reduce conductor proximity effect losses to provide enhanced efficiency and gain since the high current medial region is reduced.

In particular, diagram 60 shows the voltage standing wave ratio (VSWR) for the communications device 40 as the operating frequency is varied. The values of the noted points on the curve are 61: 6.04 at 162.39 MHz; 62: 5.14 at 162.55 MHz; 63: 1.32 at 163.92 MHz; and 64: 5.91 at 165.45 MHz Diagram 60 illustrates an advantageous quadratic resonant response, and the antenna of the communications device 40 provides a desirable 50 Ohm resistive load. For this simulation, the communications device 40 had the following characteristics:

TABLE 1

Exemplar Performance Of A 1.5" Embodiment

| Parameter | Value | Basis |
|---|---|---|
| Size | 1.5 inches diameter ( | Measured |
| Diameter in wavelengths | λ/47 | Measured |
| Inner hole diameter | 0.163 inches | Measured |
| Slotted opening 50 width | Tapered 0.050 to 0.120 inches | Implemented |
| Feedpoints | across slot 50 0.668 inches from outer rim | Measured |

TABLE 1-continued

Exemplar Performance Of A 1.5" Embodiment

| Parameter | Value | Basis |
|---|---|---|
| Realized Gain | −16.3 dBil | Calculated |
| Antenna electrical size | λ/73 or 0.014 wavelengths diameter | Calcualted |
| Efficiency | 1.5% | Calculated |
| Approximate radiation resistance | 80 micro-ohms | Calculated |
| Approximate metal conductor resistance | 5 milliohms | Calculated |
| Driving Impedance | 50 ohms | Nominal/ specified |
| VSWR | 1.3 to 1 | measured |
| Resonating capacitor | 100.0 picofarads | Manufacturer specification |
| Fixed tuned 2 to 1 VSWR bandwidth | 0.99% | Measured in free space |
| Fixed tuned 3 dB gain bandwidth | 1.86% | Measured in free space |
| Q | 107 | Calculated |
| Tunable bandwidth | >400% | Measured by chip capacitor substitution |
| Materials | 0.0007 inch copper | Measured |
| Radiation pattern | Mostly toroidal | Measured |
| Polarization | Horizontal when the antenna plane is horizontal | Measured |

As can be seen from Table 1, the communications device 40 continues to tune and provide some radiation at even extremely small electrical size relative wavelength. At 1000 MHz, the communications device 40 provides 90 percent radiation efficiency and +1.3 dBi gain at 1.4 inches diameter, which is an electrical size of 0.12 wavelengths. The gain units of dBil in Table 1 refer to decibels with respect to an isotropic antenna and are for linear polarization. As background, the gain of a ½ wave dipole antenna is +2.1 dBil.

Diagrams 70, 80 show simulated curling current in the electrically conductive antenna layer 41 of the communications device 40. Diagram 70 shows the amplitude contours of the electric currents in amperes/meter at an applied RF power of 1 watt. As can be appreciated by the skilled person, the highest current density is near the antenna feedpoints 72, 74. The antenna area is mostly filled with conductive structure, and a sheet current is caused for reduced metal conductor losses. In these simulated results, the diameter of the electrically conductive antenna layer 41 (copper) is 1.0 inch (λ/72) and the communications device 40 was operated at 162.55 MHz. Diagram 80 shows the predominant orientations of the electric currents on the antenna surfaces. As can be seen, two distinct modes exist: a slot dipole mode $I_{slot}$ and a loop mode $I_{loop}$. The slot dipole mode is formed by the divergence of anti-parallel currents of equal amplitude and opposite direction on either side of the keyhole slotted opening 50. The loop mode is formed by the curling currents to and from the keyhole slotted opening 50. In the prior art, the thin wire loop 100, (FIG. 6B) $I_{slot}$ does not appreciably exist. $I_{slot}$ provides the operative advantage of a transmission line impedance transformer in situ to realize adjustment of feedpoint resistance, and 50 ohms is readily accomplished. Additionally, the wedged keyhole shape of the slotted opening 50 may reduce conductor proximity effect losses (conductor proximity effect being the crowding of electric currents on the adjacent conductor surfaces which can increase loss resistance).

Figure 7A:
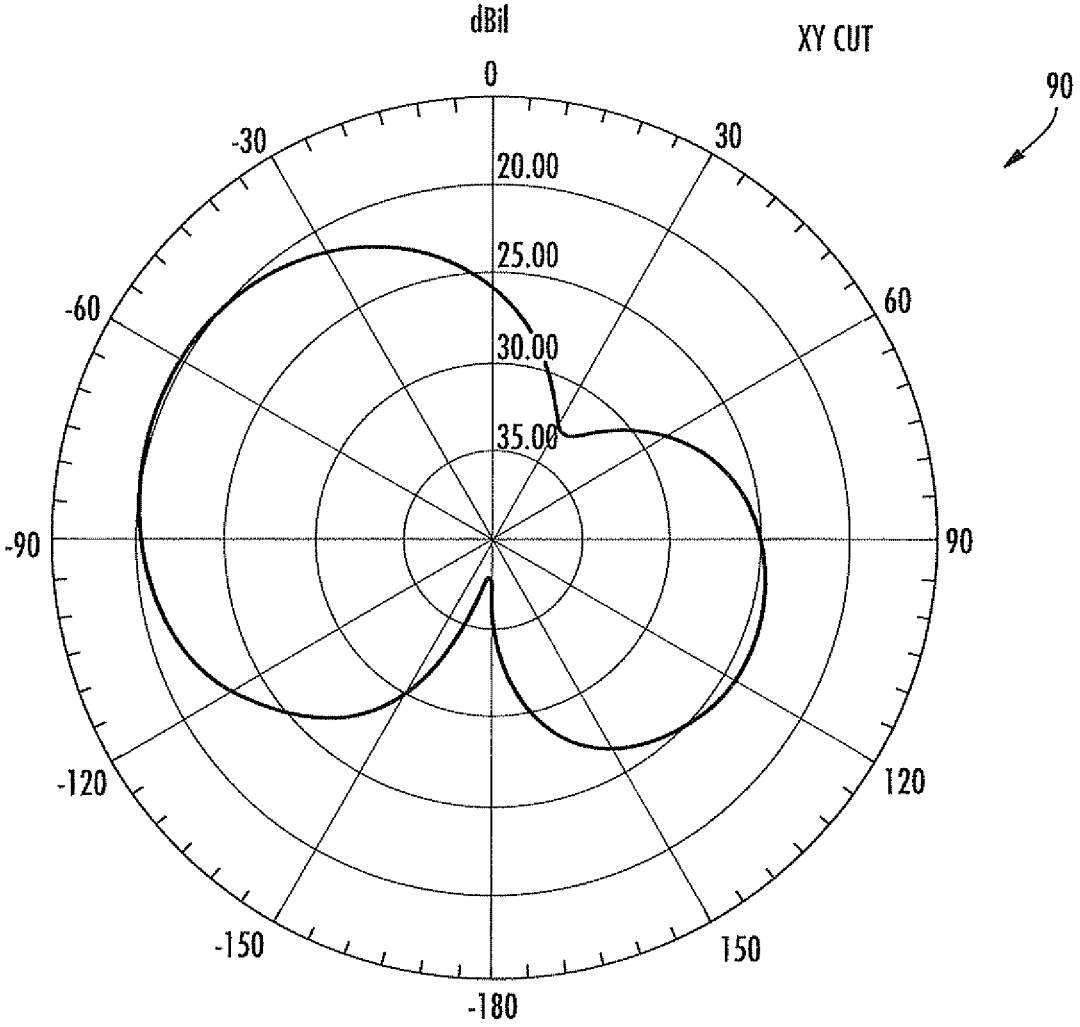
FIG. 7A is a diagram of the XY plane free space radiation pattern cut of an example of the communications device, according to the present invention.
Figure 7B:
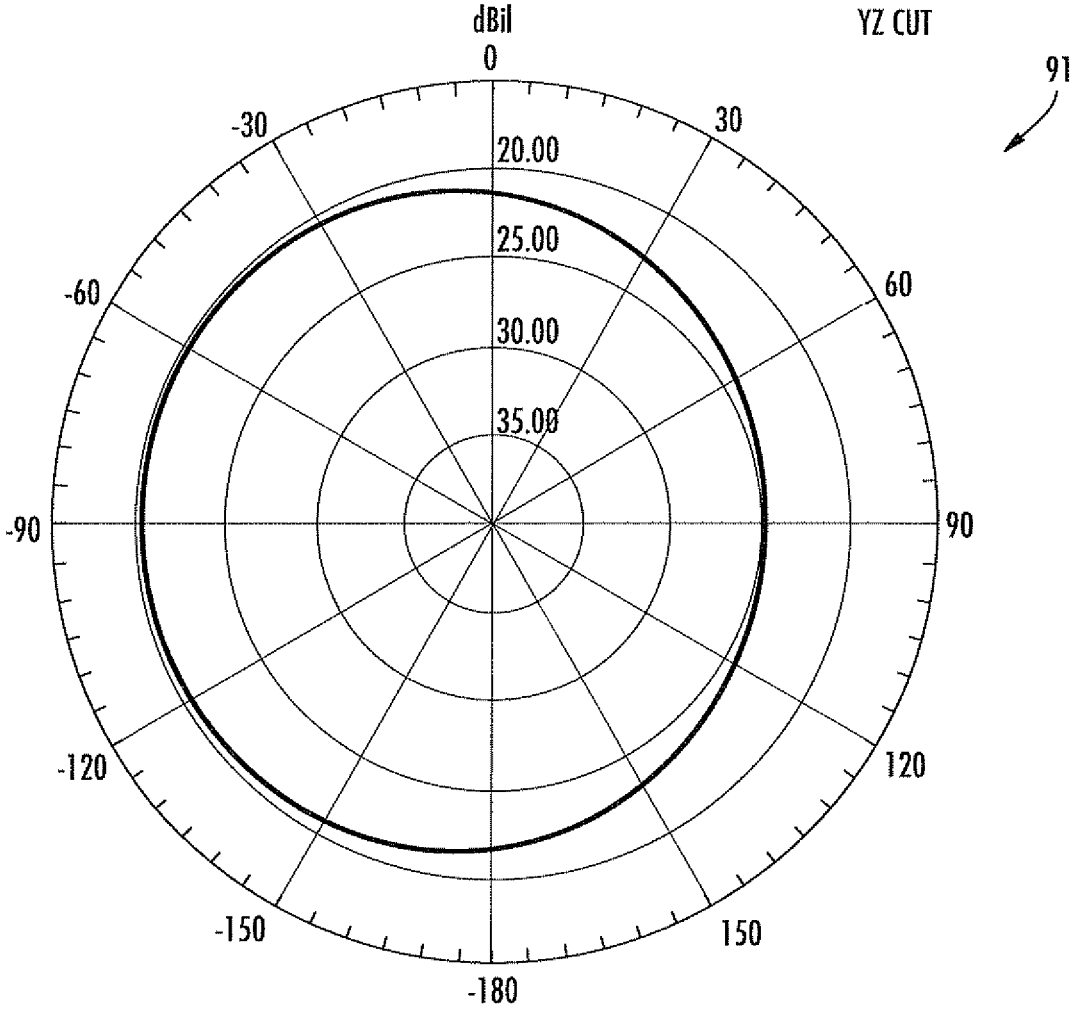
FIG. 7B is a diagram of the YZ plane free space radiation pattern cut of an example of the communications device, according to the present invention.
Figure 7C:
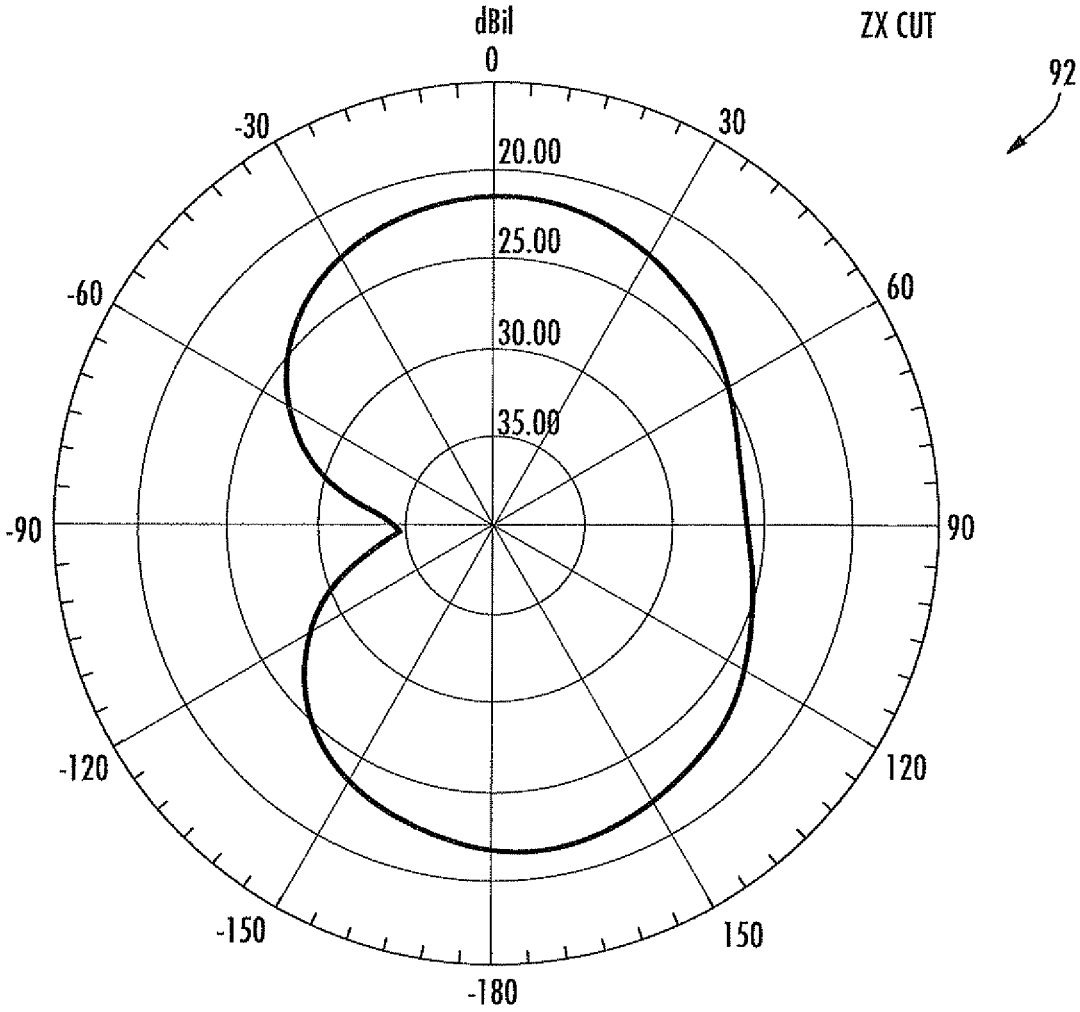
FIG. 7C is a diagram of the ZX plane free space radiation pattern cut of an example communications device, according to the present invention.

FIG. 7A includes diagram 90 and shows the XY plane free space radiation pattern cut of an example the communications device 40. FIG. 7B includes a diagram 91 showing the YZ plane free space radiation pattern cut of an example the communications device 40. FIG. 7C includes a diagram 92 showing the ZX plane free space radiation pattern cut of an example the communications device 40.

As will be appreciated by those skilled in the art, the radiation pattern is toroidal shaped (isometric view not shown) and omnidirectional in the YZ plane. The polarization is linear and horizontal when the antenna plane is horizontal, so the radiated E field was linear and horizontal when the antenna plane was horizontal. The communications device 40 provides some radiation at even λ/73 in diameter and increased radiation efficiency at larger electrical size. Total fields are plotted and the units are dBil or decibels with respect to an isotropic antenna having linear polarization. The radiation patterns are partially hybrid between the electrically small loop and a slot dipole, i.e. the slotted opening 50 provides some radiation as a slot dipole although the circular body predominates in the radiation pattern as a loop. This may be advantageous in unoriented communications devices as some radiation occurs both in plane and broadside. The E field strength produced from the communication device 40 is approximately given by:

$$E_\phi=[\mu\omega Ia/2r][J_1(\beta \sin \theta);$$

where:

μ=permeability for free space in farads/meter;

ω=the angular frequency=2πf;

I=the curling current in amperes;

a=the radius of the communications device in meters, e.g. the diameter divided by two;

r=the distance from the communications device in meters;

$J_1$=Bessel function of the first order, of argument (βa sin θ); and

θ=the angle from the loop plane in radians (broadside is n/2 radians).

Figure 11:
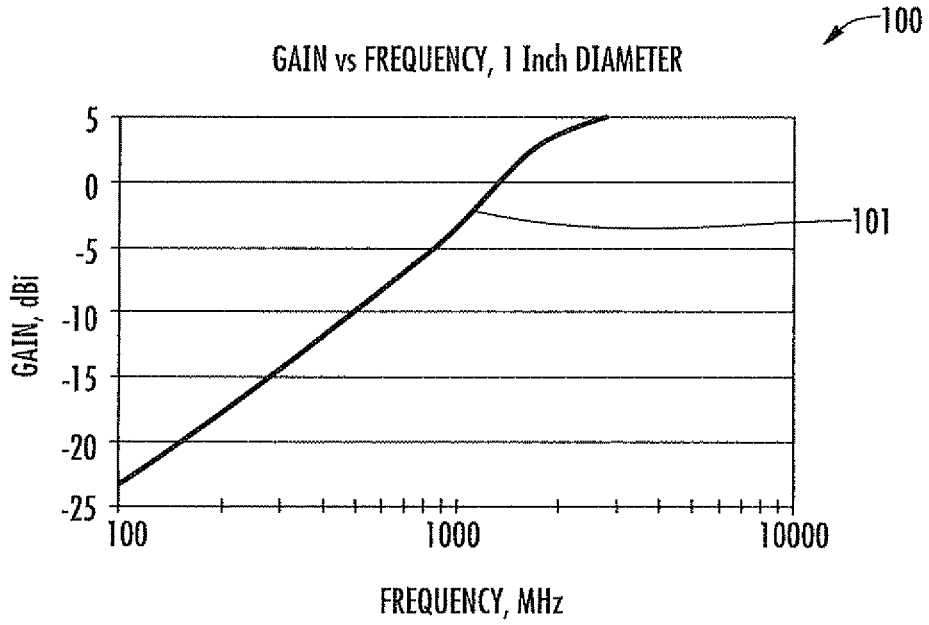
FIGS. 11-12 are diagrams of gain values of the communications device, according to the present invention.
Figure 12:
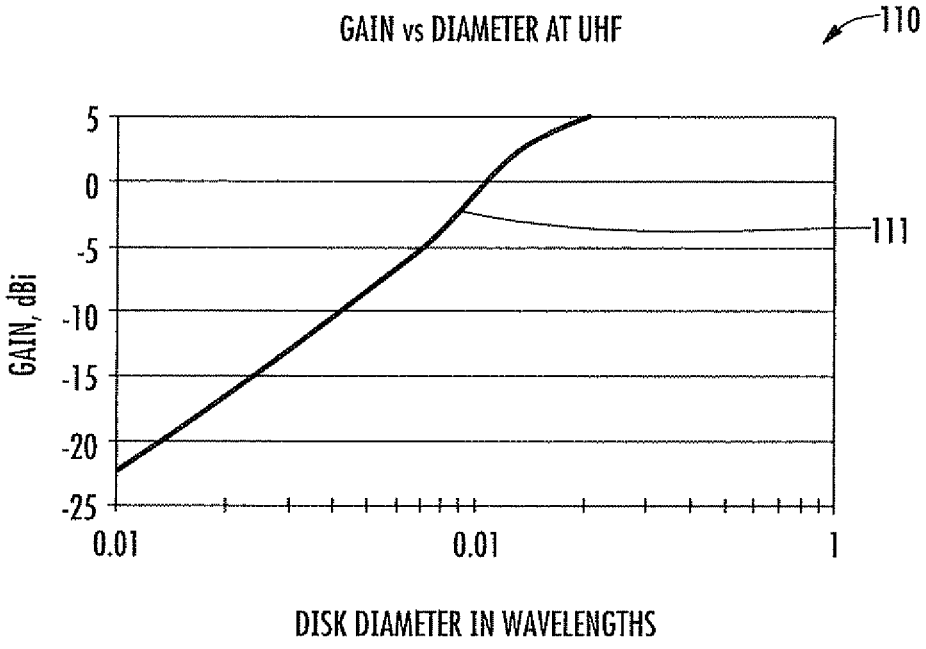

Referring now additionally and briefly to FIGS. 11-12, diagrams 100 and 110 show the gain performance of the communications device 40 as operating frequency and the diameter of the electrically conductive antenna layer 41 vary, respectively. Curves 101 and 111 both show predictable gain characteristics with frequency, about a 12 dB per octave as the antenna becomes larger electrically.

Figure 8:
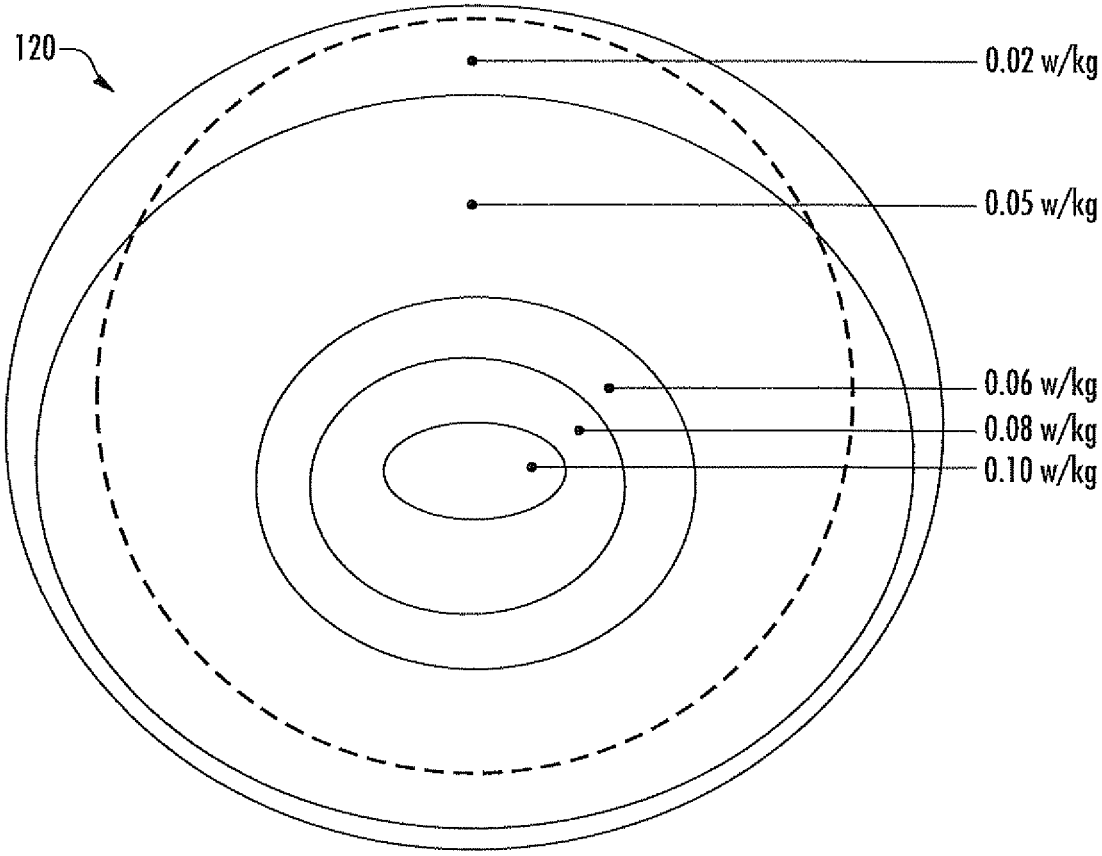
FIG. 8 is a diagram of specific absorption rate of an example of the communications device, according to the present invention.

FIG. 8 and diagram 120 show the specific absorption rate (SAR) of an operating example of the communications device 40. The units in the figure are watts-kilogram. The simulation projects the heating characteristics in human flesh adjacent when an embodiment of the present invention is worn by a person. The bottom of the antenna is 0.1 inches above the human body, the antenna diameter is 1.0 inch, and the frequency is 162.55 MHz Background on human exposure limits to RF electromagnetic fields may be found in IEEE Standard C95.1™-2005 "IEEE Standard For Safety Levels with Respect To Human Exposure to Radio Frequency Electromagnetic Fields 3 KHz to 300 GHz".

As can be appreciated from diagram 120, the peak SAR realized in the example was 0.1 W/kg in a localized area. Table 6 of the above mentioned IEEE standard (not shown) advises that localized area SAR levels of 2 W/kg are permissible for the general public so the exposure example is permissible and low SAR may be an advantage of the present invention. SAR levels of course vary with frequency, power level, distance to the body etc. As appreciated by the skilled person, IEEE standard general public SAR limits in 2010 were 0.08 W/kg whole body, 2 W/kg localized exposure to 10 g of tissue, and 4 W/kg localized exposure to the hands. At VHF frequencies, body heating may primarily be caused by induction of eddy electric currents in to the conductive flesh by the antenna magnetic near fields. The theoretical radian sphere distance (near field=far field) for the example was λ/2π=11.6 inches, and the analysis did include the effects of all fields near and far. At UHF frequencies, dielectric heating from antenna near E fields can be more pronounced. At ranges beyond the near fields (r>λ/2π), SAR effects diminish according to wave expansion ($\frac{1}{4}\pi r^2$) so doubling the distance to the body reduces the SAR by a factor 4 or 6 dB.

A theory of operation for the embodiment of FIG. 2 follows. The communications device 40' implements a compound antenna design including two antenna mechanisms: curl and divergence to provide a combination loop antenna and slot dipole antenna. The antenna layer 41' curls electric currents to provide the loop and the slotted opening 50' diverges currents to provide the slot dipole. The radiation is the Fourier transform of the curling and diverging currents, and the driving point impedance is according to the Lorentz radiation equation.

The slotted opening 50' functions as a tapped slotline transmission line and a distributed element impedance transformer therein. Thus, a method to adjust the load resistance of the antenna is provided by adjustment of the dimensions of the slotted opening 50', particularly, the circular portion 58' of the slotted opening. Increasing the size of the circular portion 58' increases the load resistance and decreasing the size of the circular portion 58' decreases the resistance. Preferred outer diameters for the housing 46 in the range of about 0.01 to 0.1 wavelengths, and the antenna is primarily directed towards electrically small operation relative the free space wavelength. The present invention provides a 50 ohm resistive match from any diameter in this range. As background, many differing antennas are called loop antennas, but the typical loop antenna is probably a circle of thin wire. For example the textbook "Antennas", by John Kraus, 2$^{nd}$ ed., McGraw H111 ©1988 FIG. 6-7 pp 245 discloses a circle of thin wire as the "general case loop antenna".

The typical thin wire loop is limited in that it does not provide a means of adjusting the driving point resistance independent of the loop circumference. The present invention provides resistance control independent of antenna diameter by adjustment of the circular portion 58' size, so a method is provided.

Planar antennas may be divided according to panel, slot and skeleton forms according to Babinet's Principle. For example, a panel dipole may be comprise a long metal strip, a slot dipole a slot in a metal sheet, and a skeleton dipole an elongated rectangle of wire. In some embodiments of the present invention, the antenna is a hybrid of a panel and a slot. For instance, if no center hole were used, the loop would be conductively filled and a panel form antenna. If the center hole were sufficiently large, the structure would be hollow and a skeleton, thereby forming a hybrid panel slot.

The radiation resistance of a small wire loop is:

$$R_r=31{,}200(A^2/\lambda^2)^2;$$

where:

A=the area of the loop in meters squared; and

λ=the free space wavelength.

Bookers Relation for referring panel resistance to slots is:

$$Z_s=(377)^2/Z_p;$$

where:

$Z_s$=impedance of the slot; and $Z_p$=impedance of the panel.

Substituting the former into the latter provides:

$$R_r=(377)^2/[31{,}200(A^2/\lambda^2)^2].$$

And this is approximately the radiation resistance of the communications device 40 for small center hole sizes, which can be important for radiation efficiency. The driving point resistance of the antenna is of course different from the radiation resistance, and the driving point resistance may be adjusted to any value desired, such as 50 ohms. This is because the antenna layer 41' is wide and planar to permit a keyhole shaped slotted opening 50' therein, which functions as an impedance transformer.

The antenna has single control tuning, for example, the frequency of operation can be set over a wide range (many octaves) simply by adjustment of the value of the capacitor (or the permittivity of the dielectric insert) in the keyhole notch. The realized gain of the antenna is related to the ratio of the radiation resistance to the directivity, the radiation resistance, and the metal conductor loss by:

$$G_r \approx 10 \log_{10} 1.5(R_r/R_r+R_l);$$

where:

$G_r$=realized gain in dBil;

$R_r$=the antennas radiation resistance in ohms;

and $R_l$=the metal conductor loss resistance in ohms.

The factor of 1.5 is related to the directivity of electrically small antennas and as background the directivity of most loops and dipoles becomes 1.5 when they are vanishingly small. The realized gain units of dBil refers to decibels with respect to a linearly polarized isotropic antenna. The term realized gain includes the effects of dissipative losses and mismatch losses, however the antenna is assumed to be properly tuned and match in impedance herein. In practice, the losses of the loading capacitors can be small and in some circumstances may be neglected. The present invention has an exceptionally broad tunable bandwidth of 10 to 1 by adjustment of a single component value: the capacitor value in farads. The instantaneous gain bandwidth, for example, the fixed tuned bandwidth, is related to the antenna size due to wave expansion rates, which are sometimes known as the Chu-Harrington limit $1/kr^3$.

Figure 9:
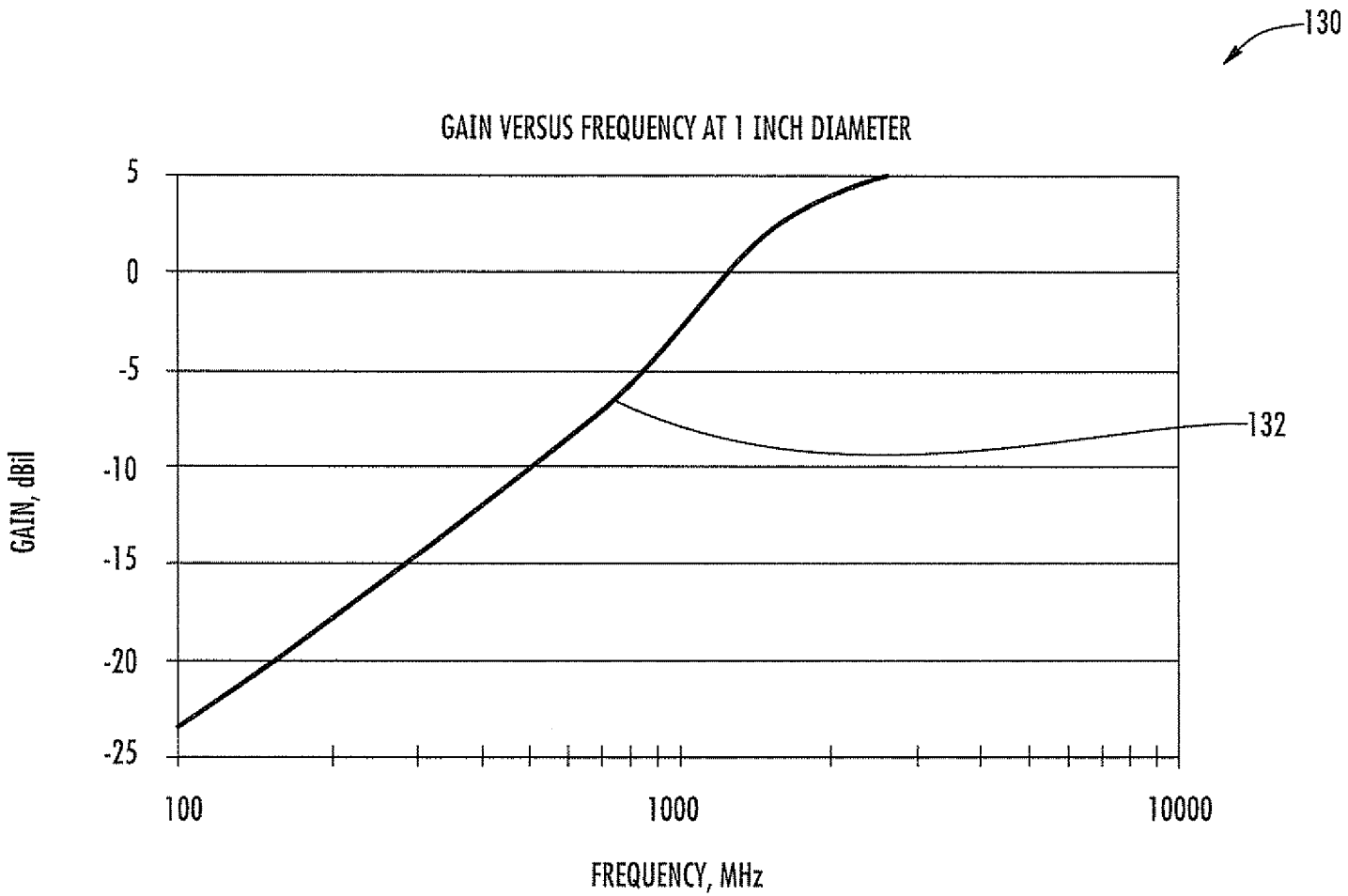
FIG. 9 is a graph of the realized gain of a one inch diameter example of the communications device, according to the present invention.

FIG. 9 includes a graph 130 with a curve 132 showing the realized gain of an example embodiment of the present inventions. The outer diameter of the communications device 40 was constant at 1.0 inch and it was made of copper conductors. The rising gain with frequency is due to the increase in radiation resistance relative conductor loss resistance.

Figure 10:
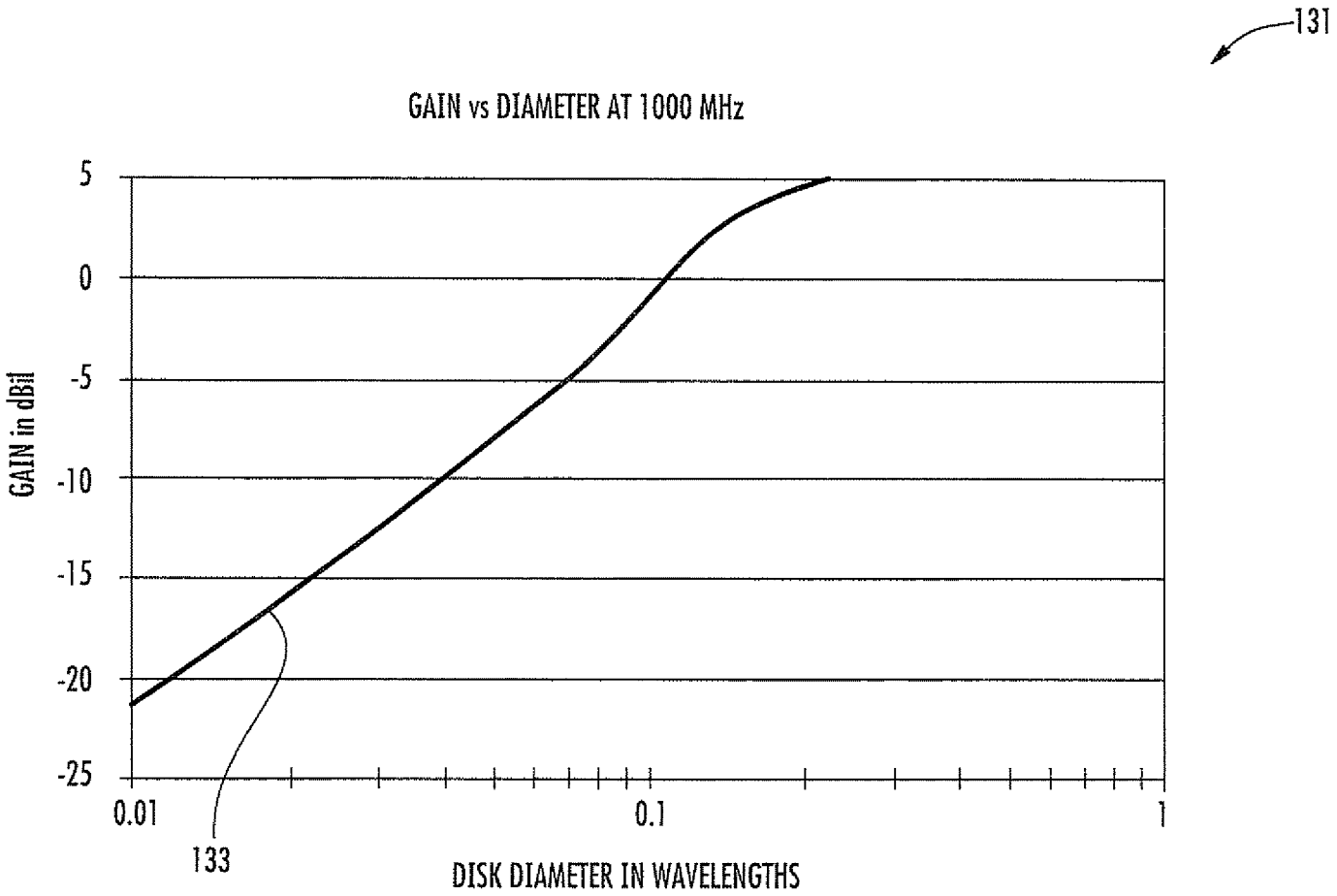
FIG. 10 is a graph of the realized gain of an example of the communications device, according to the present invention.

FIG. 10 includes a graph 131 with a curve 133 showing a the realized gain of the communication device 40 at 1000 MHz. The diameter of communications device 40 was varied to make the plot and increasing gain was seen at larger sizes. In general, larger antennas provide increased performance. The present invention advantageously allows a continuous size and gain trade to take advantage of this, as well as good absolute efficiency for size. The communications device 40 has large conductive surfaces to minimize joule effect losses and can tune with capacitors, which can have negligible losses or nearly so.

The embodiments of the present invention have been tested and found to provide good reception and availability of Global Position System (GPS) satellites even when randomly oriented. The communications device tested had a diameter of 1.1 inch and the GPS L1 frequency was at 1575.42 Mhz. The linear polarization of the present invention advantageously avoided the deep cross sense fades common to circular polarized receive antennas when they become inverted.

As appreciated by those skilled in the art, a constant 3 dB theoretical loss exists when circular and linearly polarized antennas are used together but an infinite loss is theoretical when cross sense circular polarization antennas are used. For randomly oriented antennas, the occurrence of cross rotational sense circular polarization fading cannot be avoided. Thus, linear polarization GPS reception can be a useful trade as radio communication fading is statistical and the deepest fades define the required power if high availability/reliability are a needed. So the present invention provides a well integrated GPS radiolocation tag that does not need to be aimed or oriented, as well as being useful for other purposes.

Advantageously, the communications device 40 provides an insitu multi-layer PCB with current traces curling around the keyhole shaped slotted structure 50. The resistance load of the electrically conductive antenna layer 41 can be easily varied for the needed application by adjusting the size of the keyhole shaped slotted structure 50. Moreover, the multi-layer PCB forms the tuning structure of the communications device 40 using the first and second dielectric layers 42, 44, the tuning device 47, and the electrically conductive passive antenna tuning members 43*a*-43*e*. Further to this point, the communications device 40 may be scalable to any size at any frequency, tunable over broad multi-octave bandwidths, and readily manufactured with low per unit costs.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A communications device comprising:

an electrically conductive antenna layer having a slotted opening therein, said slotted opening comprising a circular portion adjacent an inner portion of said electrically conductive antenna layer, and a slot portion coupled to said circular portion and opening outwardly to a perimeter of said electrically conductive antenna layer, said electrically conductive antenna layer comprising a plurality of antenna feed points being across said slotted opening and along a circumference of said circular portion;

a first dielectric layer adjacent said electrically conductive antenna layer;

at least one electrically conductive passive antenna tuning member adjacent said first dielectric layer;

a second dielectric layer adjacent said at least one electrically conductive passive antenna tuning member;

circuitry on said second dielectric layer; and a plurality of electrically conductive vias extending through said first and second dielectric layers and coupling said circuitry and the plurality of antenna feed points.

2. The communications device of claim 1 wherein the slotted opening is keyhole-shaped.

3. The communications device of claim 1 further comprising a tuning capacitor coupled across the slotted opening.

4. The communications device of claim 1 further comprising dielectric fill material within the slotted opening.

5. The communications device of claim 1 wherein the slotted opening has a progressively increasing width from the inner portion to the perimeter of said electrically conductive antenna layer.

6. The communications device of claim 1 wherein the slotted opening has a uniform width from the inner portion to the perimeter of said electrically conductive antenna layer.

7. The communications device of claim 1 wherein said circuitry comprises:

a wireless circuit coupled to said electrically conductive antenna layer; and a battery coupled to said wireless circuit.

8. The communications device of claim 1 further comprising a pressure-sensitive adhesive layer adjacent said electrically conductive antenna layer.

9. The communications device of claim 1 wherein said electrically conductive antenna layer, and said first and second dielectric layers are circularly-shaped.

10. The communications device of claim 1 wherein said electrically conductive antenna layer, and said first and second dielectric layers, are rectangularly-shaped.

11. The communications device of claim 1 wherein said electrically conductive antenna layer includes linear slots therein.

12. A communications device comprising:

a circularly-shaped electrically conductive antenna layer having a keyhole-shaped slotted opening therein, said keyhole-shaped slotted opening comprising a circular portion adjacent an inner portion of said circularly-shaped electrically conductive antenna layer, and a slot portion coupled to said circular portion and opening outwardly to a perimeter of said circularly-shaped electrically conductive antenna layer, said circularly-shaped electrically conductive antenna layer comprising a plurality of antenna feed points being across said keyhole-shaped slotted opening and along a circumference of said circular portion;

a first circularly-shaped dielectric layer adjacent said circularly-shaped electrically conductive antenna layer;

at least one electrically conductive passive antenna tuning member adjacent said first circularly-shaped dielectric layer;

a second circularly-shaped dielectric layer adjacent said at least one electrically conductive passive antenna tuning member;

circuitry on said second circularly-shaped dielectric layer; and a plurality of electrically conductive vias extending through said first and second circularly-shaped dielectric layers and coupling said circuitry and the plurality of antenna feed points.

13. The communications device of claim 12 further comprising a tuning capacitor coupled across the keyhole-shaped slotted opening.

14. The communications device of claim 12 further comprising dielectric fill material within the keyhole-shaped slotted opening.

15. The communications device of claim 12 wherein the keyhole-shaped slotted opening has a progressively increasing width from the inner portion to the perimeter of said circularly-shaped electrically conductive antenna layer.

16. The communications device of claim 12 wherein the keyhole-shaped slotted opening has a uniform width from the inner portion to the perimeter of said circularly-shaped electrically conductive antenna layer.

17. A tracking device comprising:

a housing;

a pressure-sensitive adhesive layer on an exterior of said housing;

an electrically conductive antenna layer carried by said housing and having a slotted opening therein, said slotted opening comprising a circular portion adjacent an inner portion of said electrically conductive antenna layer, and a slot portion coupled to said circular portion and opening outwardly to a perimeter of said electrically conductive antenna layer, said electrically conductive antenna layer comprising a plurality of antenna feed points being across said slotted opening and along a circumference of said circular portion;

a first dielectric layer carried by said housing and adjacent said electrically conductive antenna layer;

at least one electrically conductive passive antenna tuning member carried by said housing and adjacent said first dielectric layer;

a second dielectric layer carried by said housing and adjacent said at least one electrically conductive passive antenna tuning member;

a wireless tracking circuit on said second dielectric layer; and a plurality of electrically conductive vias extending through said first and second dielectric layers and coupling said wireless tracking circuit and the plurality of antenna feed points.

18. The tracking device of claim 17 wherein the slotted opening is keyhole-shaped.

19. The tracking device of claim 17 further comprising a tuning capacitor coupled across the slotted opening.

20. The tracking device of claim 17 wherein the slotted opening has a progressively increasing width from the inner portion to the perimeter of said electrically conductive antenna layer.

21. A method of making a communications device comprising:

forming an electrically conductive antenna layer having a slotted opening therein, the slotted opening comprising a circular portion adjacent an inner portion of the electrically conductive antenna layer, and a slot portion coupled to the circular portion and opening outwardly to a perimeter of the electrically conductive antenna layer;

forming a plurality of antenna feed points in the electrically conductive antenna layer across the slotted opening and along a circumference of the circular portion;

positioning a first dielectric layer adjacent the electrically conductive antenna layer;

forming at least one electrically conductive passive antenna tuning member adjacent the first dielectric layer;

positioning a second dielectric layer adjacent the at least one electrically conductive passive antenna tuning member;

positioning circuitry on the second dielectric layer; and forming a plurality of electrically conductive vias that extend through the first and second dielectric layers and couple the circuitry and the plurality of antenna feed points.

22. The method of claim 21 wherein the forming of the electrically conductive antenna layer includes forming the slotted opening to be keyhole-shaped.

23. The method of claim 21 further comprising coupling a tuning capacitor across the slotted opening.

24. The method of claim 21 further comprising filling the slotted opening with a dielectric fill material.

25. The method of claim 21 further comprising forming a pressure-sensitive adhesive layer adjacent the electrically conductive antenna layer.

26. A communications device comprising:

an electrically conductive antenna layer having a slotted opening therein, said slotted opening comprising a rectangle-shaped portion adjacent an inner portion of said electrically conductive antenna layer, and a slot portion coupled to said rectangle-shaped portion and opening outwardly to a perimeter of said electrically conductive antenna layer, said electrically conductive antenna layer comprising a plurality of antenna feed points being across said slotted opening, being on a perimeter of said rectangle-shaped portion, and adjacent an intersection of said rectangle-shaped portion and said slotted portion;

a first dielectric layer adjacent said electrically conductive antenna layer;

at least one electrically conductive passive antenna tuning member adjacent said first dielectric layer;

a second dielectric layer adjacent said at least one electrically conductive passive antenna tuning member;

circuitry on said second dielectric layer; and a plurality of electrically conductive vias extending through said first and second dielectric layers and coupling said circuitry and the plurality of antenna feed points.

27. The communications device of claim 26 wherein the slotted opening is keyhole-shaped.

28. The communications device of claim 26 further comprising a tuning capacitor coupled across the slotted opening.

29. The communications device of claim 26 further comprising dielectric fill material within the slotted opening.

30. A method of making a communications device comprising:

forming an electrically conductive antenna layer having a slotted opening therein, the slotted opening comprising a rectangle-shaped portion adjacent an inner portion of the electrically conductive antenna layer, and a slot portion coupled to the rectangle-shaped portion and opening outwardly to a perimeter of the electrically conductive antenna layer;

forming a plurality of antenna feed points in the electrically conductive antenna layer and being across the slotted opening, being on a perimeter of the rectangle-shaped portion, and adjacent an intersection of the rectangle-shaped portion and the slotted portion;

positioning a first dielectric layer adjacent the electrically conductive antenna layer;

forming at least one electrically conductive passive antenna tuning member adjacent the first dielectric layer;

positioning a second dielectric layer adjacent the at least one electrically conductive passive antenna tuning member;

positioning circuitry on the second dielectric layer; and forming a plurality of electrically conductive vias that extend through the first and second dielectric layers and couple the circuitry and the plurality of antenna feed points.

31. The method of claim 30 wherein the forming of the electrically conductive antenna layer includes forming the slotted opening to be keyhole-shaped.

32. The method of claim 30 further comprising coupling a tuning capacitor across the slotted opening.

33. The method of claim 30 further comprising filling the slotted opening with a dielectric fill material.

* * * * *